United States Patent [19]

Kanbara et al.

[11] 3,939,799

[45] Feb. 24, 1976

[54] MAGNETIC FORCE SEALANT FOR PLATING TANK

[75] Inventors: Shigeo Kanbara, Yokohama; Takeshi Adaniya, Fukuyama, both of Japan

[73] Assignee: Nippon Kokan Kabushiki Kaisha, Tokyo, Japan

[22] Filed: July 12, 1974

[21] Appl. No.: 488,056

[30] Foreign Application Priority Data

July 17, 1973 Japan ..... 48-79812

[52] U.S. Cl. ..... 118/620; 13/33; 118/405; 164/49

[51] Int. Cl.[2] ..... B05C 5/02

[58] Field of Search ..... 118/404, 405, 620, 429; 164/49; 13/33; 427/12, 45, 46, 431, 433, 434

[56] References Cited

UNITED STATES PATENTS

| | | | |
|---|---|---|---|
| 2,707,720 | 5/1955 | Tama | 13/33 |
| 2,743,492 | 5/1956 | Easton | 13/33 X |
| 3,014,255 | 12/1961 | Bussard et al. | 13/33 X |

*Primary Examiner*—Morris Kaplan
*Attorney, Agent, or Firm*—Flynn & Frishauf

[57] ABSTRACT

There is provided a molten metal plating method and apparatus wherein at each of the strip feeding and discharging ends of a horizontal molten metal plating tank arranged in a horizontal strip pass line, each of a current and a magnetic field which intersect each other at right angles is applied in a direction perpendicular to the direction of travel of a steel strip to apply to the molten metal at each end an electromagnetic force which is directed toward the inside of the plating tank, whereby by adjusting the intensity of the magnetic field or the amount of the current, the run-out or leakage of the molten metal from the strip feeding and discharging ends of the plating path is reduced to zero or controlled to a desired value. The effect of this is that the molten metal is effectively prevented from leaking out at the strip feeding end of the plating tank, while at the discharging end of the tank the coating thickness or the weight of coating on the plated strip is controlled, and a horizontal linear coating line is provided thus making the plating of heavy-gauge steel strip or plate and the application of thicker coatings possible.

4 Claims, 2 Drawing Figures

MAGNETIC FORCE SEALANT FOR PLATING TANK

BACKGROUND OF THE INVENTION

The present invention relates to a molten metal plating apparatus of the type in which the run-out of the molten metal contained in a horizontal molten metal plating tank inserted in a horizontal strip pass line is prevented or controlled to a desired value at the feeding and discharging ends of the plating tank for the strip.

Continuous molten metal plating methods and apparatus for the coating of steel strip with zinc, tin, lead and aluminium and their alloys are known in the art in which the coating of the strip to be plated is effected by obliquely introducing the strip from the top of the plating tank into the plating bath and vertically delivering the strip to the top of the plating tank again after passing through around the lower side of sink rolls arranged at the bottom of the plating bath in the tank.

A disadvantage of the method and apparatus of the above type is that since the sink rolls are arranged at the bottom of the bath in the plating tank to change the direction of movement of the strip, the sink rolls are eroded due to their contact with the molten metal (plating bath) and the strip, and this erosion eventually reaches to such an extent that surface defects are caused in the coated strip, thus necessitating the periodic replacement of the sink rolls. Another disadvantage is that the coating of heavy-gauge steel strip or plate requires the use of sink rolls having a greater diameter, and at present the maximum strip thickness for successful coating is considered to be on the order of 4 to 5 mm, thus failing to meet the requirements for the recent continuous molten metal plating of heavy-gauge steel strip or plate. Still another disadvantage of the method and apparatus of the above type is that due to the fact that the strip emerges vertically from the plating bath, a portion of the metal deposited on the strip runs down due to the force of gravity, and therefore in order to ensure an increased coating weight and uniform plating of the strip there is a certain limit to the maximum coating weight which is, for example, 300 $g/m^2$ in the case of zinc plating, in consideration of the viscosity of molten metal, the surface properties of base metal, etc. And therefore such conventional method and apparatus are not capable of providing coating thicker than the limit just stated.

SUMMARY OF THE INVENTION

With a view to overcoming the foregoing difficulty, it is the object of the present invention to provide a molten metal plating apparatus which are capable of accomplishing the continuous coating of steel strip with various metals on a horizontal line without the use of any sink rolls and which are thus well suited for the continuous molten metal plating of heavy-gauge material as well as for the heavy coating of material.

In accordance with the present invention, there is thus provided a molten metal plating apparatus in which at each of the feeding and discharging ends for strip of a horizontal molten metal plating tank arranged in a horizontal strip pass line, a current and a magnetic field which intersect each other at right angles are respectively applied in a direction perpendicular to the direction of travel of the strip to apply to the molten metal at each end an electromagnetic force which is directed toward the inside of the plating tank, whereby the run-out or leakage of the molten metal at either of the strip feeding and discharging ends of the plating tank is controlled to zero or to a desired value by adjusting the intensity of the magnetic field or the amount of the current. Thus, the apparatus of this invention is capable of preventing the leakage of the molten metal at the feeding end of the plating tank for the strip and controlling the weight of coating on the plated strip at the discharging end of the plating tank and provides a horizontal linear coating line which makes the coating of heavy-gauge strip or plate and the application of heavier coating weights possible.

DESCRIPTION OF THE PREFERRED EMBODIMENT

The present invention will now be described in greater detail with reference to the illustrated embodiment.

Figure 1:
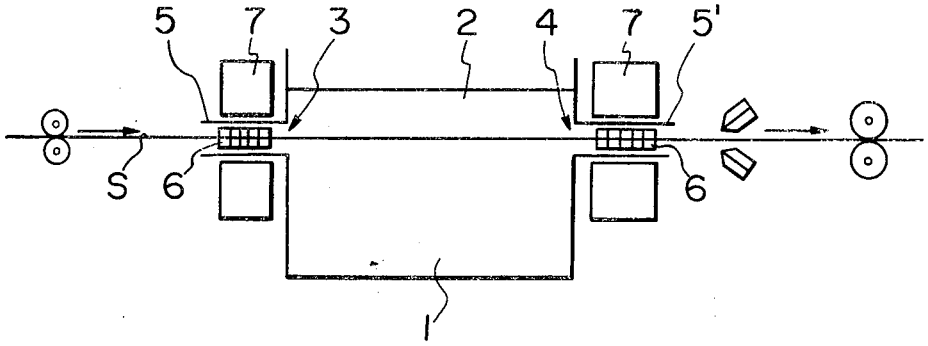
FIG. 1 is a schematic diagram showing the general arrangement of a continuous molten metal plating line embodying the present invention.
Figure 2:
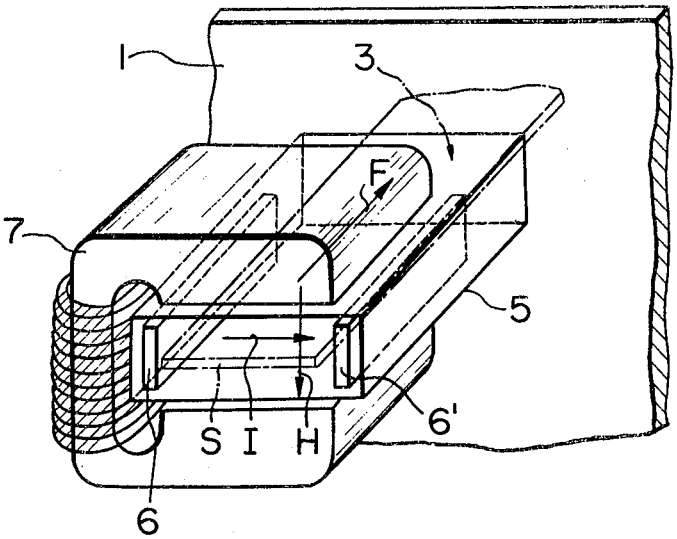
FIG. 2 is an enlarged perspective view showing the detailed construction at the strip feeding end of the plating tank used in the embodiment of FIG. 1.

As shown in the drawings, in a plating tank 1 according to the invention, a strip S travels in a horizontal direction and the strip S is plated as it is passed through a molten metal bath 2 in the plating tank 1. Disposed respectively at a feeding end 3 and a discharging end 4 of the plating tank 1 for the strip S are insulated chutes 5 and 5' which are filled with the molten metal, and the line between the chute 5 at the feeding end 3 and the chute 5' at the discharging end 4 extends linearly in a horizontal direction. Within each of the chutes 5 and 5', two electrodes 6 and 6' are arranged in parallel to the side edges of the strip S to cause a flow of current in the direction of the width of the strip S as shown in FIG. 2, and an electromagnet 7 is externally provided for each of the chutes 5 and 5' so that a magnetic field is applied substantially over the entire area of each chute in the thickness direction of the strip. Of course, a permanent magnet may be used in place of the electromagnet 7, in which case a constant magnetic field is applied. The arrangement of the electromagnet 7 and the electrodes 6 and 6' is not limited to the illustrated one. For example, they may change positions with each other.

When a current I and a magnetic field H are respectively applied to the electrodes 6 and 6' and the electromagnet 7 in the directions of arrows in FIG. 2, an electromagnetic force acts on the molten metal in the chute 5 in the direction of an arrow F, and consequently the molten metal 2 in the plating tank 1 may be prevented from flowing out of the chute 5 at the feeding end 3 by suitably adjusting the intensity of the magnetic field or the amount of the current. On the other hand, the run-out of the molten metal through the chute 5' at the discharging end 4 may be prevented in the similar manner, in which case it is necessary to change the polarity of either the electromagnet 7 or the electrodes 6 and 6' so that the resultant electromagnetic force acts in a direction opposite to that on the feeding side.

Preferably, the same polarity is used for the electrodes 6 and 6' at both of the feeding and discharging ends, and the electromagnets 7 are opposite in polarity with each other. In this case, the electrodes 6 and 6' at both of the feeding and discharging ends may be connected to a common power unit.

In the above-described chute 5' on the discharging side, the weight of the molten metal deposited on the strip S which will be delivered from the plating tank 1, may be controlled to a desired value by adjusting the intensity of the magnetic field or the amount of the current. This is done by regulating the magnitude of the electromagnetic force that prevents the above-mentioned run-out of the molten metal, so that the amount of the molten metal carried on the strip S as it emerges from the plating tank 1 is limited to an extent allowable within the range of control. In this case, coupled with the reduced effect of the gravity owing to the horizontal coating line, a considerably increased coating weight can be obtained as compared with that obtainable by the conventional methods.

The following example describes in greater detail the novel molten metal plating apparatus according to the present invention.

EXAMPLE

| | |
|---|---|
| Metal of molten plating bath: | zinc |
| Head of zinc: | 20 mm |
| Dimensions of chute | |
| Width: | 100 mm |
| Height: | 10 mm |
| Dimensions of steel strip | |
| Thickness: | 1.0 mm |
| Width: | 95 mm |
| Active length of electromagnetic force current: | 50 mm |
| DC current: | 50 A/cm² |
| Electromagnetic force: | 2,000 gauss |

The level of the zinc bath was regulated by a separately provided molten bath level regulator (not shown). With the conditions described above, the force acting on the molten zinc was about 0.05 kg/cm² and the force of the molten zinc tending to run out was about 0.014 kg/cm². The run-out of the molten zinc was prevented by the action of the electromagnetic force current. The amount of the zinc deposited was in the range 350–550 g/m² and was considerably greater than those obtained with the conventional methods.

It will thus be seen from the foregoing description that the present invention can, by virtue of the fact that current is directly supplied to the molten metal in a horizontal plating tank at each of its strip feeding and discharging ends to apply an electromagnetic force to the molten metal itself in association with the action of an ecternally applied magnetic field, provide operation which is characterized by a very high efficiency as compared with the conventional methods such as one in which is utilized the action of an indirect force produced by an induction field. Further, by virtue of the greatly simplified construction and the fact that the intensity of the electromagnetic force acting on the molten metal can be directly controlled by adjusting either the magnetic field or current, the control has improved application properties and it can also be carried out easily. In view of the fact that various operating difficulties encountered in the conventional molten metal plating methods for steel strip have been overcome by the novel horizontal linear coating line of this invention and that the coating of heavy-gauge material and the application of thicker coatings have been made possible by the apparatus of the invention, it should be appreciated that the effects of the present invention are highly useful industrially.

What is claimed is:

1. A molten metal plating apparatus comprising: two electrodes arranged within a chute at each of a feeding and discharging ends of a plating tank in parallel with the side edges of a strip to supply a flow of current in the direction of the width of said strip; and a magnet arranged on the outside of each of said chutes to apply a magnetic field substantially over the whole area of said chute in the direction of the thickness of said strip, whereby on simultaneous application of said current and magnetic field a magnetic force is developed which is directed inwardly with respect to said tank and whereby the amount of leakage of said molten metal through each of said chutes at said strip feeding and discharging ends is controlled to zero or to a desired value by suitably adjusting the amount of said current or the intensity of said magnetic field.

2. An apparatus according to claim 1, wherein said magnet is a permanent magnet.

3. An apparatus according to claim 1, wherein either said pair of electrodes or said electromagnet at said feeding end has the same polarity as that of the counterpart at said discharging end, and the other of said pair of electrodes and said electromagnet at said feeding end is opposite in polarity to the counterpart at said discharging end.

4. An apparatus according to claim 1 wherein said magnet is an electromagnet.

* * * * *